US005173005A

United States Patent [19]

Henderson et al.

[11] Patent Number: 5,173,005

[45] Date of Patent: Dec. 22, 1992

[54] PRIME MOVER ACTUATED CONCRETE CURB EXTRUDER

[76] Inventors: John W. Henderson, Rte. 1, Box 460A,, Tuttle, Okla. 73089; Gary L. Green, Rte. 1, Box 31B1Y1,, Washington, Okla. 73093

[21] Appl. No.: 708,312

[22] Filed: May 31, 1991

[51] Int. Cl.[5] ..... E01C 19/48

[52] U.S. Cl. ..... 404/98; 404/105

[58] Field of Search ..... 404/98, 104, 105; 425/64, 66; 405/268

[56] References Cited

U.S. PATENT DOCUMENTS

| | | | |
|---|---|---|---|
| 3,733,140 | 5/1973 | James | 404/98 |
| 3,749,504 | 7/1973 | Smith | 404/84.2 |
| 4,013,375 | 3/1977 | Heaton | 404/98 |
| 4,217,065 | 8/1980 | Stilwell | 404/98 |
| 4,319,859 | 3/1982 | Wise | 404/98 |
| 4.384,806 | 5/1983 | Taylor | 404/105 X |
| 4,984,932 | 1/1991 | Leone | 404/98 X |
| 5.018,955 | 5/1991 | Parrish et al. | 425/64 |
| 5,062,737 | 11/1991 | Samuels | 404/104 X |

*Primary Examiner*—Ramon S. Britts
*Assistant Examiner*—Nancy P. Connolly
*Attorney, Agent, or Firm*—Robert K. Rhea

[57] ABSTRACT

A continuous concrete curb forming apparatus is formed by a vertical open end sleeve-like hopper having a channel-like member connected with its depending opening forming the shape of a conventional concrete curb as wet concrete poured in the hopper is released from the channel member.

The hopper is connected with one end of a rectangular frame mounted on the forward end of a tractor. Hydraulically operated cylinders on the apparatus are connected with the tractor hydraulic system and a sensing means responsive to the position of a horizontal guide strand defining the position of the concrete curb to be extruded are connected with the hydraulic system through servo-mechanisms for guiding the tractor and maintaining the hopper and extruding channel in close spaced relation with the surface of a roadbed on which the concrete curb is to be extruded.

2 Claims, 5 Drawing Sheets

PRIME MOVER ACTUATED CONCRETE CURB EXTRUDER

BACKGROUND OF THE INVENTION

1. Field of the Invention

This invention relates to roadway construction and more particularly to forming curbs at respective sides of streets to be paved.

It has been common practice, in preparing roadways or the soil where streets are to be paved, to grade the soil to an elevation relative to the surrounding area so that the street level will be below the surface of the earth at either side of the street.

After preparing the roadbed a series of longitudinal, generally planar concrete curb forms are disposed in longitudinal alignment along each side of the street to be paved. These forms must be braced and tied together to prevent spreading in opposing directions by the mass of the wet concrete when poured therebetween. Further, considerable manpower is required, not only in erecting and removing the forms for the pouring of concrete, but also in the finishing of the surface of the curb in which one side of the curb is considerably higher than the other or street level side.

This invention eliminates the necessity of erecting the concrete forms, troweling or forming the surface of the concrete when poured in the forms and the removal of the forms after the concrete has "set" by providing a concrete continuous curb extruder moved along the street by a prime mover.

2. Description of the Prior Art

We do not know of any patents disclosing an apparatus such as is disclosed by the specification of this invention.

SUMMARY OF THE INVENTION

A rectangular frame mounted on the four point implement hitch of a prime mover of the front loader type, laterally supports a wet concrete receiving hopper having a downward and rearward discharge opening formed by walls defining the cross-sectional configuration of a conventional concrete street curb. Hydraulically operated vibrators in the concrete hopper insure an even mix and continuous flow of wet concrete to the extruding opening. The prime mover hydraulic fluid system is connected with pressure cylinders on the apparatus.

Horizontal and vertical strand guide sensing arms contacting a guide wire and actuating servo-mechanisms interposed in the hydraulic circuit operate the pressure cylinders to assure maintaining the prime mover and concrete extruder at a predetermined elevation and on a predetermined course.

The principal object of this invention is to provide an automatic concrete curb extruder for continuously laying a length of street curbing and eliminating the necessity of using concrete forms and considerably reducing the labor cost in construction of street curbs.

DESCRIPTION OF THE PREFERRED EMBODIMENTS

Figure 1:
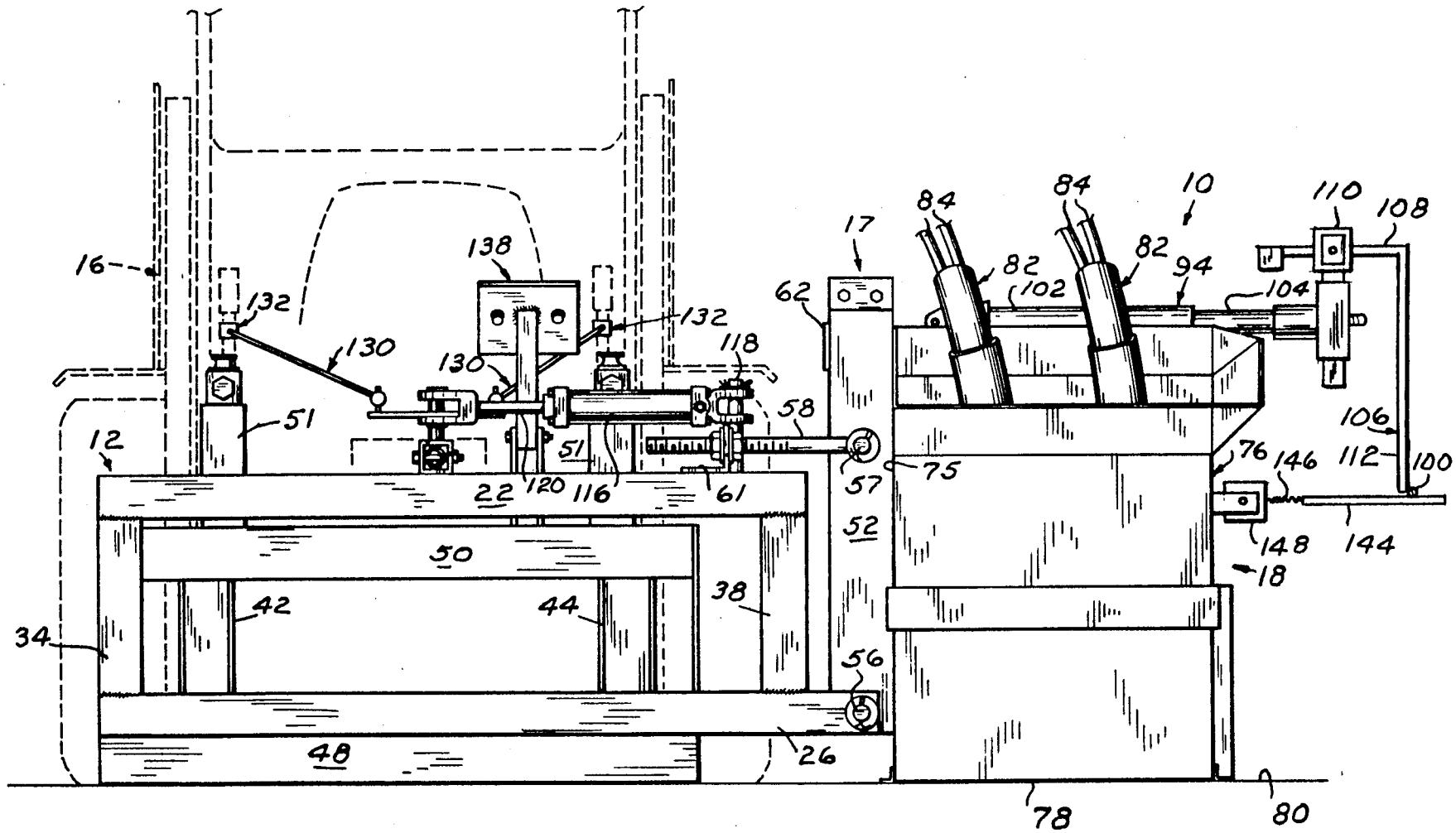
FIG. 1 is a front elevational view of the device connected with a prime mover, the latter being shown by solid and dotted lines.

Like characters of reference designate like parts in those figures of the drawings in which they occur.

In the drawings:

The reference numeral 10 indicates the apparatus as a whole which is generally rectangular in overall configuration.

Referring first to FIGS. 1–4, the apparatus 10 comprises a generally open framework 12 having tractor attachment means 14 on its rearward surface for connecting the frame 12 with the front end lift booms 15 of a close coupled front-end loading tractor generally known by the trademark "Bobcat", and fragmentarily indicated by the dotted lines 16.

Figure 3:
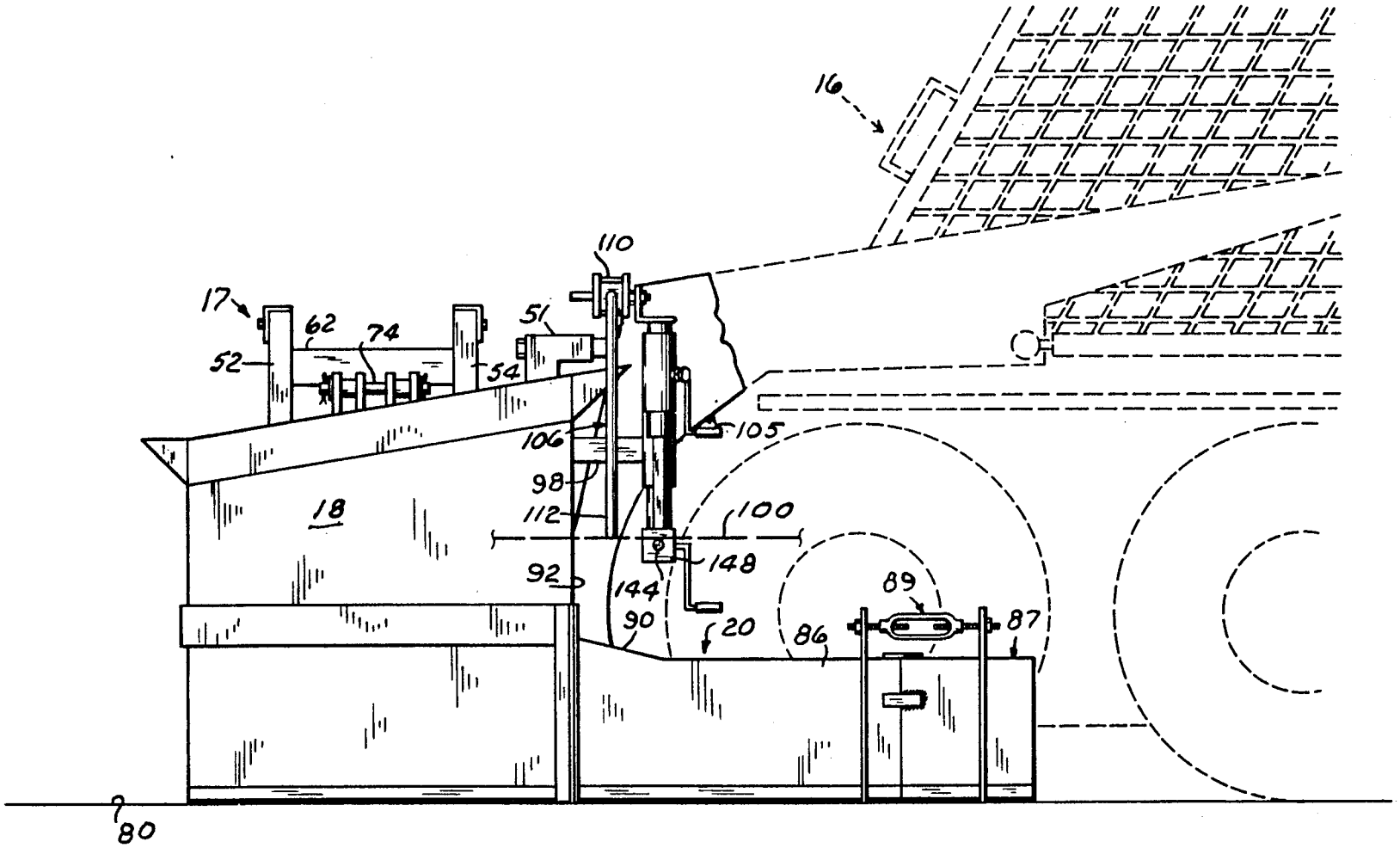
FIG. 3 is a left end elevational view of the device, with concrete vibrators removed for clarity, illustrating its position relative to a prime mover, the latter being shown by dotted lines.

One end of the frame 12 is connected, by an elevating cylinder means 17, with a concrete receiving hopper 18 having a rearward concrete curb form extruding channel 20 (FIG. 3).

Frame Means

Figure 2:
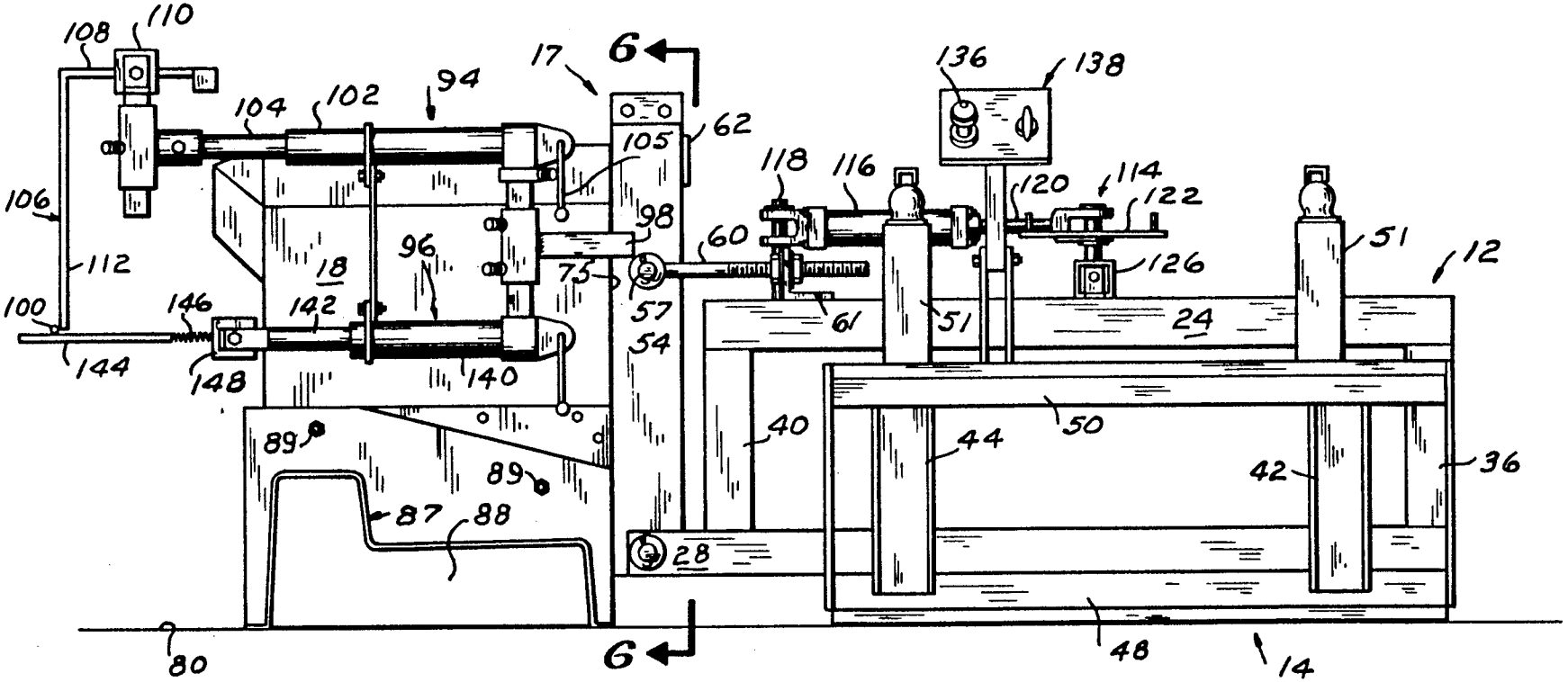
FIG. 2 is a rear elevational view of the device, per se.
Figure 4:
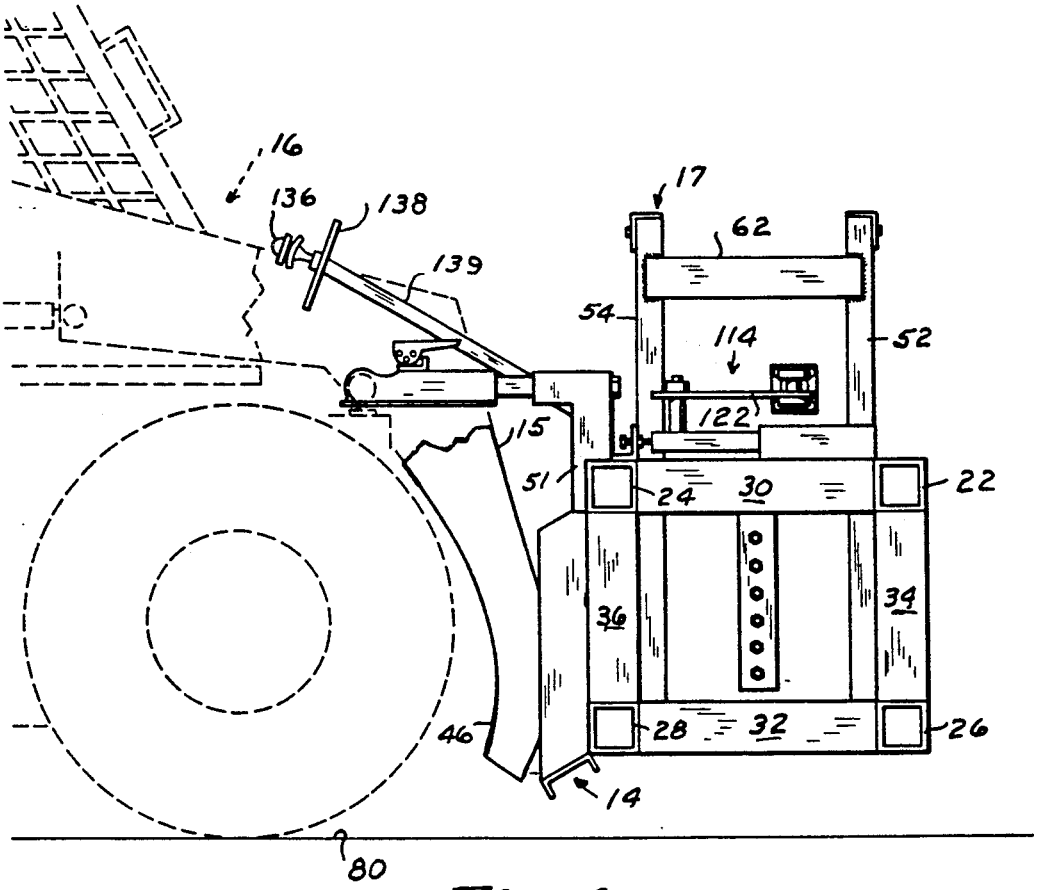
FIG. 4 is a right end elevational view with the hopper and its elevating cylinder removed for clarity, illustrating the frame position when lifted relative to the surface of the earth and a prime mover, the latter being shown by dotted lines.

The frame means 12 comprises a pair of horizontal upper box channel beams 22 and 24 disposed transversely of the tractor 16 in front to rearward parallel spaced relation and are substantially equal in length with the width of the tractor. Similarly, a pair of lower beams 26 and 28 are spaced downwardly in horizontal parallel relation with respect to the top pair of beams 22–24. The top and bottom beams being connected at their respective ends by upper and lower horizontal braces 30 and 32, only two being shown (FIG. 4). The respective ends of the pairs of beams 22–24 and 26–28 are connected at their respective ends by four vertical standards 34, 36, 38 and 40, as shown by FIGS. 1, 2 and 4 respectively.

The beams 26 and 28 are extended beyond their respective uprights 38 and 40 for connection with the depending end portion of the elevating cylinder means 17 as presently explained.

The frame to tractor attachment means 14 comprises a pair of channels 42 and 44 disposed vertically on the rearward surfaces of the frame beams 24 and 28 and are cooperatively spaced apart horizontally a distance substantially equal with respect to the spacing of the tractor lift booms 46. A bottom pressure plate 48 extends horizontally between and beyond the channels 42 and 44. Similarly a top lift plate 50 coextensive with the bottom pressure plate 48 receives the conventional implement attaching means carried by the tractor lift booms 46 for securely anchoring the frame means 12 to the tractor booms 46 in a conventional manner. A pair of stabilizing arms 51 forming a part of the attachment means 14 connects the upper portion of the frame 12 to the tractor 16.

Hopper Elevator

Figure 6:
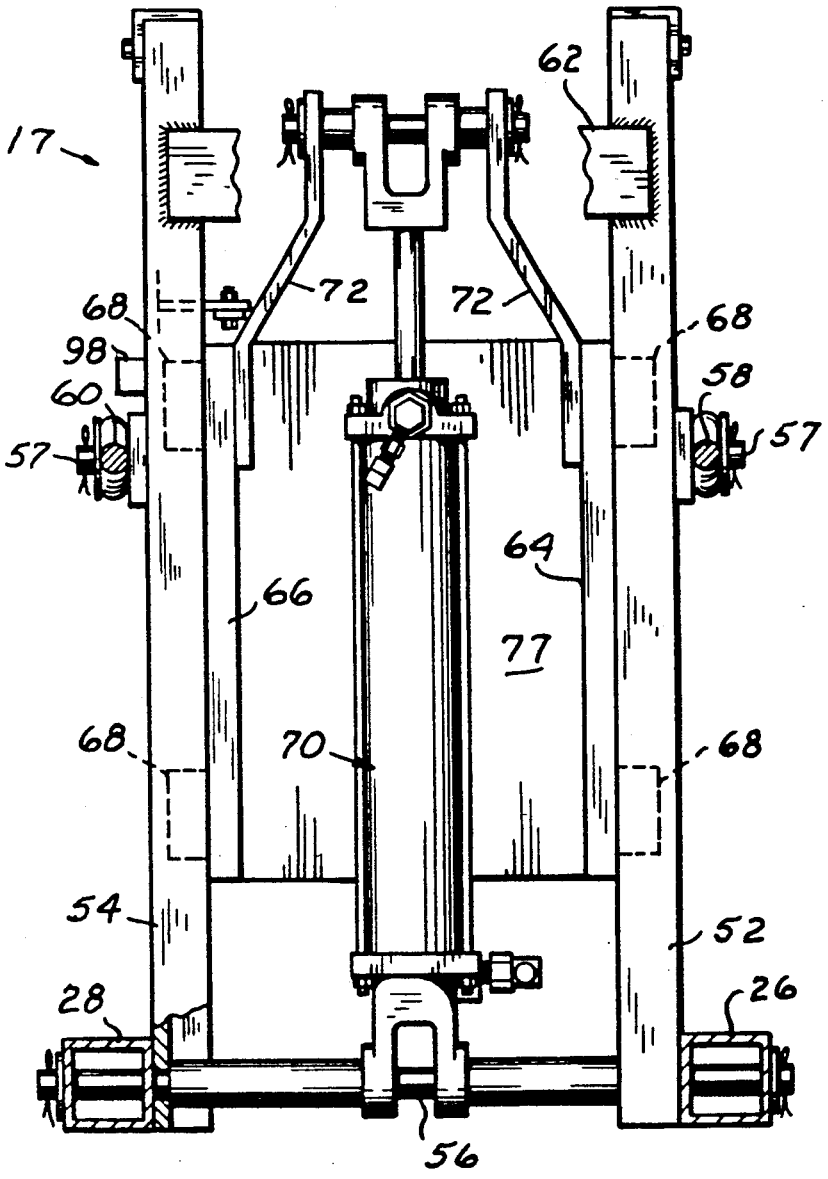

Referring also to FIG. 6, the elevating cylinder means 17 comprises a pair of upright parallel forward and rearward channels 52 and 54, respectively, of a selected length pivotally connected at their depending ends on a horizontal axle 56 with the legs of the channel shapes disposed in confronting relation. The front to rear spacing between the channels 52 and 54 is substantially equal to the horizontal spacing between the frame beams 26 and 28.

Respective end portions of the axle 56 are extended through the respective end portions of the frame beams 26 and 28 so that the top portion of the elevating cylinder channels may pivot vertically about the horizontal axis of the axle 56 for the purposes presently explained.

Intermediate their ends, the respective forward and rearward surface of the channel supports 52 and 54 are provided with a pair of horizontal stub shafts 57 entering the I-bolt end of adjusting rods 58 and 60 having their threaded ends extending through L-shaped brackets 61 mounted on the frame top beams 22 and 24, respectively, and having nuts on the rods for adjusting the vertical position of the channel uprights 52 and 54 as presently explained.

The top end portion of the uprights 52 and 54 are rigidly interconnected by a horizontal brace 62.

Upright sliding frame members 64 and 66 longitudinally disposed adjacent the legs of the respective channel 52 and 54 are each guided vertically by upper and lower pairs of vertically spaced bearing blocks or rollers 68 secured to the respective sliding frame member 64 and 66 and disposed between the respective channel legs for sliding movement of the frame members 64 and 66 by a pressure cylinder 70. One end of the cylinder 70 is secured to the axle 56 and its piston rod end is secured by top brackets 72, respectively connected with the upper end portion of the sliding frame member 64 and 66 by a top axle 74 extending between the brackets 72.

Thus, when the piston rod of the pressure cylinder 70 is extended or retracted the sliding frame members 64 and 66 move vertically, in accordance with the extension or retracting of the piston rod, with respect to the channel members 52 and 54 to raise or lower the hopper means 18 as presently explained.

Hopper Means

The concrete hopper means 18 comprises an upward and downwardly open rectangular sleeve-like passageway 76 having one Q vertical wall 75 disposed adjacent the lift means 17. A mounting plate 77 (FIG. 6) is flatly secured to the hopper wall 75 and in turn is rigidly connected as by welding, to the sliding frame members 64 and 66 opposite the frame means 12.

The bottom end of the passageway 76 is open to the surface of the roadbed 80 and the top edge portion of its forward, rearward and lateral wall opposite the lift means 17, is outwardly flared for the purpose presently believed obvious.

A pair of conventional hydraulic eccentric vibrators 82 are positioned in the passageway 76 in selected lateral spaced relation and are connected by tubes 84 with the hydraulic system, not shown, of the tractor 16.

Extruding Means

The concrete extruding means 20 comprises a downwardly open channel 86 having a cross-sectional configuration substantially defining the cross section configuration of a conventional concrete street curb, as indicated by the numeral 88.

The channel 86 extends upwardly, as at 90, at its forward end and is connected with a rearward wall 92 of the hopper passageway 76 around an opening therein, not shown. A similarly shaped finishing form 87 (FIG. 3) is preferably attached to the exit end of the channel 86. Turnbuckles 89 are adjusted so that the rearward edge portion of the form 87 bears against the concrete, not shown, to insure a smooth top surface.

Sensing Means

Direction and elevation sensing means 94 and 96, respectively, are mounted on a rearwardly projecting horizontal T-shaped stub arm 98 secured to the elevating means rearward channel 54.

The purpose of the tractor direction sensing means 94 is to guide the tractor along a predetermined course, namely, a wire or strand 100 tautly stretched between two points at a selected elevation laterally of the longitudinal position of the concrete curb to be formed.

The direction sensing means comprises a conventional cylindrical telescoping trailer tongue jack 102 horizontally mounted on a vertical shaft 103 and vertically adjustably supported by the T-shaped stub arm 98. The jack telescoping rod portion 104 is extendable and retractable by manually turning a crank 105 in a manner common with trailer tongue jacks.

A sensing arm 106 substantially inverted L-shaped in side elevation, has its foot portion 108 operatively connected, intermediate its ends, with a servo-mechanism 110 supported by the cylindrical rod 104.

The leg 112 of the sensing arm 106 contacts, at its depending end portion one side of the tautly stretched strand 100 so that any lateral deviation of the tractor from the predetermined course is sensed by the depending end of the sensing leg 106 which signals the servo-mechanism 110 for correcting the direction of the tractor travel through a tractor guide control means 114 (FIG. 5) mounted on the upper surface of the frame means 12.

Figure 5:
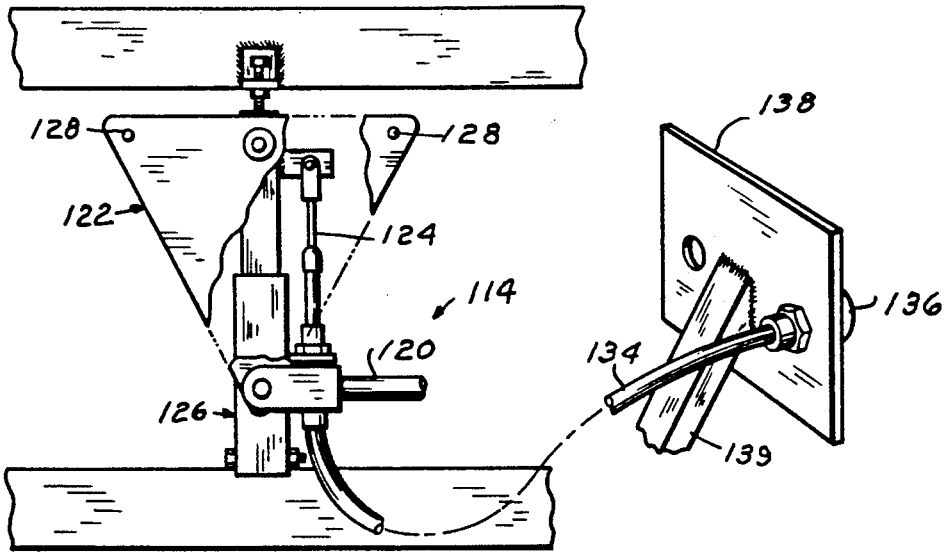
FIG. 5 is a fragmentary top view, with parts broken away for clarity, of the direction and speed controls; and, FIG. 6 is a view to an enlarged scale, partially in cross-section, of the concrete hopper elevation control cylinder and support frame, looking in the direction of the arrows 6—6 of FIG. 2.

Referring also to FIG. 5, the guide means 114 comprises a pressure cylinder 116 having a stationary end secured to a upstanding rod 118 on the top surface of the frame means 12 adjacent the elevating means 17. The piston rod 120 of the cylinder 116 is connected with the apex end of a triangular, in top view, guide plate 122.

The isosceles triangular shaped guide plate 122 is pivotally mounted horizontally medially its base side on a telescoping rod spring-urged extension 124 of a tube 126 mounted beneath the guide plate 122 on the top surface of the frame 12 in longitudinal alignment with the tractor 16.

The respective base side corner portions 128 of the triangular guide 122 are connected by rods 130 (FIG. 1) with the tractor, normally manually operated direction guide means 132 for guiding the tractor in a path parallel with the position of the strand 100, as presently explained.

The guide means 114 further includes a control member 134 connected at one end with the tube 126 extension member 124 with its knob control end portion 136 mounted on a control panel 138 (within reach of the tractor driver) and supported by a shaft 139 extending rearwardly from the frame means 12 so that manipulation of the control knob 136 longitudinally retracts the extension member 124 into its housing tube 126 permitting movement or angular rotation of the triangular guide plate 122.

The elevation sensing means 96 similarly comprises a trailer tongue jack 140 having a crank operated telescoping rod 142 supporting a horizontal sensing arm 144 connected by a spring 146 with a servo-mechanism 148. Any vertical variation of the position of the sensing arm 144 away from the strand 100 or bearing against its depending surface signals the servomechanism 148 controlling the fluid pressure to the elevating cylinder 70 to extend or retract its piston rod in accordance with the position of the sensing arm 144 relative to the strand 100 to thus maintain the depending end opening of the hopper housing 76 and the curb form extruding means 20 in close contact with the surface of the earth 80.

Operation

In operation, assuming the apparatus has been connected with the tractor 16 as described hereinabove and that the guiding strand 100 has been stretched between two stationary supports, not shown, defining a predetermined path on which a concrete curb is to be extruded.

The tractor 16 and the apparatus 10 is manually positioned by operating the hydraulic controls of the tractor to position the sensing arms 112 and 144 adjacent the position of the guide strand 100 and the tractor aligned with the direction of travel.

The sensing arms are then manually adjusted to contact the guide strand by rotating the cranks of the cylinders 94 and 96.

The hopper 76 is initially filled with wet concrete, not shown. The vibrators 82 and 84 are activated and the tractor gears engaged for forward movement of the tractor and apparatus 10.

During forward movement of the tractor 16 and the apparatus 10, the hopper housing 76 is continuously supplied with wet concrete in a manner well understood in the art of laying asphalt roadway surfaces.

Obviously the invention is susceptible to changes or alterations without defeating its practicability. Therefore, we do not wish to be confined to the preferred embodiment shown in the drawings and described herein.

We claim:

1. A continuous concrete street curb extruding apparatus, comprising:

a prime mover having hydraulically actuated controls operated by an onboard hydraulic system and having implement connecting forwarding disposed hitch means;

concrete hopper means having upper and lower inlet and outlet openings for receiving and depositing, by gravity flow, a quantity of wet concrete mixture in a pliable state on the surface of a roadbed;

primary frame means connecting said hopper means with said hitch means for movement in a path laterally of the path of travel of said prime mover;

curb forming channel means operatively connected with said hopper means adjacent its outlet opening for forming a curb shaped surface on the concrete deposited on the surface of the roadbed in response to forward movement of said prime mover;

direction sensing means supported by said hopper means and responsive to the position of a horizontal tautly stretched strand defining a predetermined path of travel and operatively connected with said hydraulic system for guiding said prime mover and said hopper means along the predetermined travel path;

elevating frame means interposed between said hopper means and said primary frame means for maintaining said hopper means and said curb forming means in close spaced relation with respect to the surface of the roadbed, said elevating frame means comprising: a pair of upstanding channel members pivotally connected at their depending end portions with said primary frame means for vertical pivoting movement about a horizontal axis;

sliding frame members supported by said channel members for vertical movement of said sliding frame members relative to said channel members;

plate means for connecting said hopper means with said sliding frame members;

pressure cylinder means disposed between and connected with said sliding frame members for raising and lowering said hopper means relative to said channel members; and, I-bolt means interposed between said channel members and said primary frame means for positioning said channel members at a predetermined angle with respect to the top surface of the primary frame means.

2. The apparatus according to claim 1 and further including;

elevation sensing means supported by said hopper means in sliding contact with the strand and responsive to the spacing between the strand and the surface of the roadbed and operatively connected with said hydraulic controls for maintaining said hopper means at a predetermined elevation relative to the surface of the roadbed.

* * * * *